US011466371B2

(12) United States Patent
Huck et al.

(10) Patent No.: US 11,466,371 B2
(45) **Date of Patent: *Oct. 11, 2022**

(54) ANODE ASSEMBLY WITH REDUCED ATTENUATION PROPERTIES FOR CATHODIC PROTECTION SYSTEMS

(71) Applicant: Matcor, Inc., Chalfont, PA (US)

(72) Inventors: Theodore Andrew Huck, Berwyn, PA (US); Glenn Wright Shreffler, III, North Wales, PA (US)

(73) Assignee: Matcor, Inc., Chalfont, PA (US)

( * ) Notice: Subject to any disclaimer, the term of this patent is extended or adjusted under 35 U.S.C. 154(b) by 437 days.

This patent is subject to a terminal disclaimer.

(21) Appl. No.: 16/590,803

(22) Filed: Oct. 2, 2019

(65) Prior Publication Data

US 2020/0048778 A1 Feb. 13, 2020

Related U.S. Application Data

(63) Continuation of application No. 15/678,601, filed on Aug. 16, 2017, now Pat. No. 10,465,297, which is a continuation of application No. 14/725,148, filed on May 29, 2015, now Pat. No. 9,850,584.

(60) Provisional application No. 62/015,734, filed on Jun. 23, 2014.

(51) Int. Cl.

| | |
|---|---|
| ***C23F 13/10*** | (2006.01) |
| ***C23F 13/06*** | (2006.01) |
| ***C23F 13/20*** | (2006.01) |

(52) U.S. Cl.

CPC ..... *C23F 13/10* (2013.01); *C23F 13/06* (2013.01); *C23F 13/20* (2013.01)

(58) Field of Classification Search

CPC ..... C23F 13/02; C23F 13/06; C23F 13/08; C23F 13/10; C23F 13/16; C23F 13/18; C23F 13/20; C23F 2213/20; C23F 2213/30

See application file for complete search history.

(56) References Cited

U.S. PATENT DOCUMENTS

| | | | | |
|---|---|---|---|---|
| 3,616,354 | A * | 10/1971 | Russell | C23F 13/04 205/724 |
| 4,544,464 | A | 10/1985 | Bianchi et al. | |
| 5,505,826 | A * | 4/1996 | Haglin | C23F 13/06 204/196.16 |
| 5,948,218 | A * | 9/1999 | Kheder | C23F 13/08 204/196.33 |
| 6,461,082 | B1 * | 10/2002 | Smith | C23F 13/10 204/196.17 |
| 8,502,074 | B2 * | 8/2013 | Schutt | B29C 45/14336 174/77 R |
| 9,850,584 | B2 * | 12/2017 | Huck | C23F 13/06 |

(Continued)

*Primary Examiner* — Alexander W Keeling
(74) *Attorney, Agent, or Firm* — Caesar Rivise, PC

(57) ABSTRACT

An anode assembly is disclosed for use in a cathodic protection system. The anode assembly includes an elongated housing, an electrical cable, an anode, and electrically conductive backfill. The housing has a leading end and a trailing end through which the electrical cable extends. The anode is located within the housing and is in the form of a plurality of electrically conductive segments which are spaced apart from each other and which are electrically connected to the electrical cable at respective electrically conductive joints. The backfill surrounds the anode and cable within the housing.

2 Claims, 1 Drawing Sheet

(56) References Cited

U.S. PATENT DOCUMENTS

| | | | | |
|---|---|---|---|---|
| 10,465,297 | B2 | 11/2019 | Huck et al. | |
| 2014/0262756 | A1* | 9/2014 | Shreffler, III | C23F 13/12<br>204/196.37 |

* cited by examiner

ANODE ASSEMBLY WITH REDUCED ATTENUATION PROPERTIES FOR CATHODIC PROTECTION SYSTEMS

CROSS-REFERENCE TO RELATED APPLICATIONS

This utility application is a continuation of and claims the benefit under 35 U.S.C. § 120 of U.S. application Ser. No. 15/678,601, filed on Aug. 16, 2017, entitled Anode Assembly with Reduced. Attenuation Properties for Cathodic Protection Systems, which in turn is a continuation of and claims the benefit under 35 U.S.C. § 120 of U.S. application Ser. No. 14/725,148, filed on May 29, 2015, entitled Anode Assembly with Reduced Attenuation Properties for Cathodic Protection Systems, now U.S. Pat. No. 9,850,584, which claims the benefit under 35 U.S.C. § 119(e) of Provisional Application Ser. No. 62/015,734 filed on Jun. 23, 2014, entitled Anode Assembly With Reduced Attenuation Properties for Cathodic Protection Systems. The entire contents of each of the foregoing applications are expressly incorporated herein by reference thereto.

FIELD OF THE INVENTION

This invention relates generally to cathodic protection systems and more particularly to linear anode assemblies for use in such systems.

BACKGROUND OF THE INVENTION

Cathodic protection systems commonly make use of packaged linear anodes having a variety of shapes (e.g., round, flat, or other shapes) and may be either a polymeric cable anode or a Mixed Metal Oxide (MMO) wire anode housed inside a braided or unbraided fabric housing filled with conductive backfill. These commercially available fabric-based linear anodes are similar in design and function. One particularly useful packaged linear anode for cathodic protection systems is commercially available from Matcor, Inc., the assignee of the subject invention, under the trademark SPL-FBR.

MATCOR manufactures the SPL-FBR linear anode product. This is a product that MATCOR developed many years ago and several companies now manufacture a similarly designed product. The product consists of a continuous MMO coated Titanium wire anode (anode) run in parallel to an internal insulated electrical conductor (cable) and connected at numerous uniformly spaced locations.

The SPL-FBR linear anode assembly, like other linear anodes of other manufacturers which make use of the wire anode being connected to the cable at numerous uniformly spaced locations therealong suffers from a drawback from the standpoint of electrical attenuation, particularly if the anode assembly is long and the available power for the corrosion protection system of which the anode is a part is limited. In this regard, when the availability of power is limited, there is an attenuation factor that occurs as current continuously discharges off the anode. As you move further and further away from the end of the anode assembly which connected to the DC power supply, the voltage diminishes and the current being discharged off the anode drops precipitously.

Accordingly, a need exists for a linear anode assembly which addresses that problem. The anode assembly of the subject invention achieves that end.

All references cited and/or identified herein are specifically incorporated by reference herein.

SUMMARY OF THE INVENTION

In accordance with one aspect of the invention there is provided an anode assembly for use in a cathodic protection system. The anode assembly has a leading end and a trailing end and comprises an electrical cable and an anode. The anode comprises a plurality of electrically conductive segments, each of the electrically conductive segments has a leading end and a trailing end. The leading and trailing ends of the electrically conductive segments are electrically connected to the electrical cable at respective electrically conductive joints along the length of the electrical cable, with immediately adjacent electrically conductive segments being spaced from each other by a gap.

In accordance with a preferred aspect of this invention the anode assembly additionally comprises a housing having a leading end and a trailing end and an electrically conductive backfill. The electrically conductive backfill is located within the housing, with the anode extending along the electrical cable within the housing and surrounded by the backfill.

In one preferred exemplary embodiment the length of each of the electrically conductive segments is at least 3 meters, with the length of each of the electrically conductive segments being the same length. In that embodiment the length of each of the gaps is 6 or 9 meters, with each of the gaps being of the same length. Moreover, the electrical cable comprises at least one electrically conductive wire and an electrically insulated covering and wherein each of the electrically conductive joints comprises a body of electrically insulating material which is molded in situ about the joint so that it completely covers and encapsulates the joint and is integrally bonded directly to portions of the electrically insulated covering.

DETAILED DESCRIPTION OF THE PREFERRED EMBODIMENT

Figure 1:
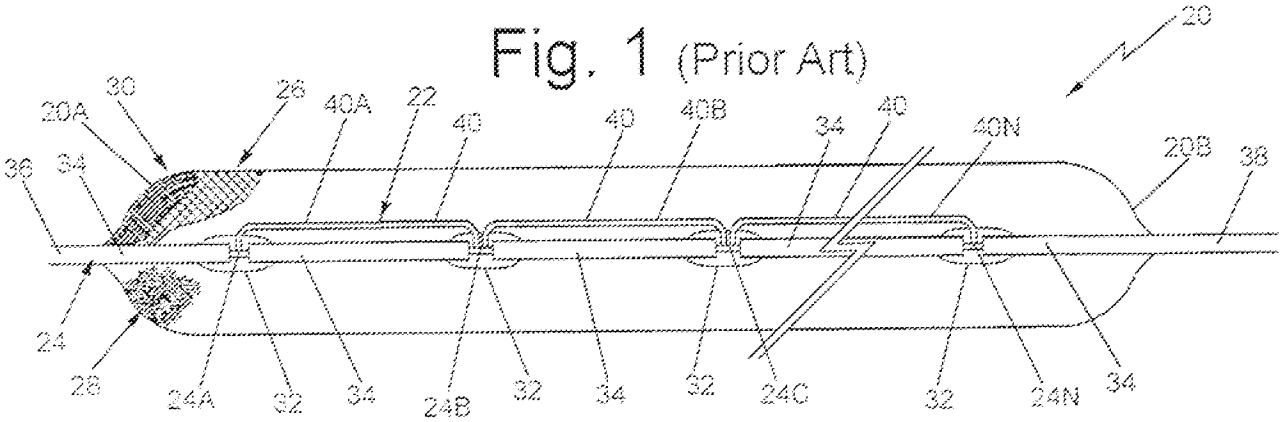
Fig. 1 (Prior Art)
FIG. 1 is a side elevation illustration of a prior art linear anode assembly for use in a cathodic corrosion protection system.
Figure 2:
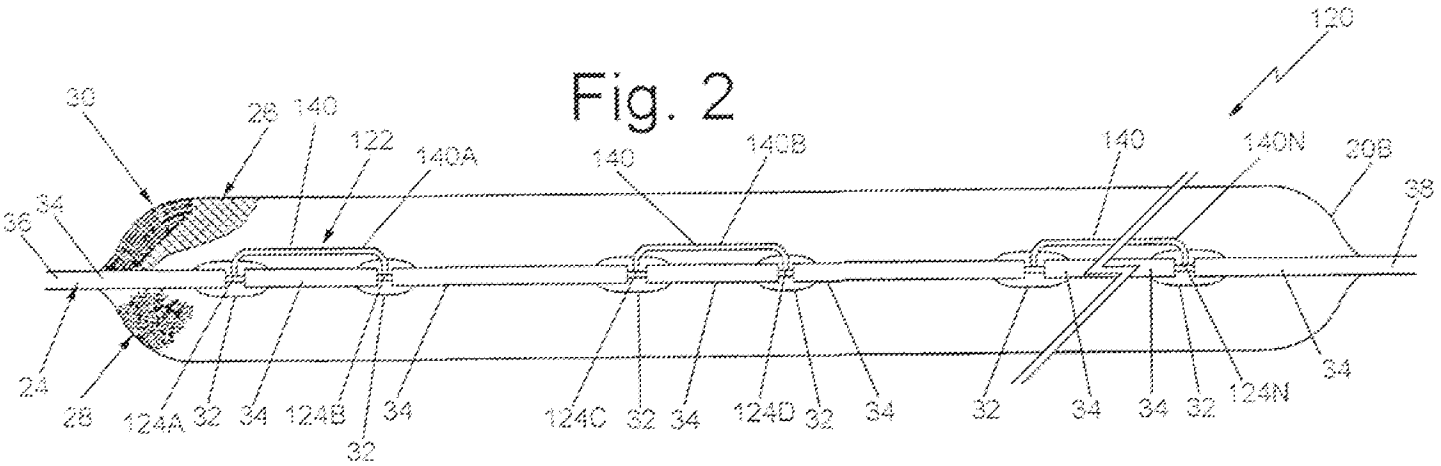
FIG. 2 is a side elevation illustration of an anode assembly constructed in accordance with the subject invention for use in a cathodic corrosion protection system.

Referring now to the various figures of the drawing wherein like reference characters refer to like parts, there is shown at 120 in FIG. 2 one exemplary embodiment of a linear anode assembly constructed in accordance with the subject invention. The anode assembly 120 is similar to a SPL-FBR anode assembly 20 (FIG. 1) available from Matcor, Inc., the assignee of the subject application, except for the construction and arrangement of its anode (which will be described shortly).

The details of the prior art SPL-FBR anode assembly are shown in FIG. 1. Thus, as can be seen that prior art anode assembly 20 basically comprises an anode 22, an internally insulated electrical conductor or cable 24, a porous outer fabric or cloth housing 26, an electrically conductive, e.g., coke, backfill 28, and external braiding 30 which provides additional support for the housing. The anode assembly 20 can be of any length, from 10 feet to lengths of more than 1,000 feet.

The cable 24 is of any conventional construction, e.g., it comprises a plurality of electrically conductive, copper strands or filaments having an electrically insulating covering or coating 34, e.g., KYNAR® polyvinylidene fluoride, thereon. The cable is centered in the housing and extends therethrough so that one portion 36 extends outside of the trailing end 20A of the anode assembly, while an opposite portion 38 extends out of the leading end 20B of the anode assembly.

The anode 22 is formed of elongated thin flexible member, e.g., a wire, a ribbon, a tube, etc., which is electrically conductive, e.g., is a noble metal combination, such as a mixed metal oxide (MMO) over titanium or platinum over niobium/copper, or any other conventional anode material(s). The anode 22 is continuous in that it extends along the cable 24 virtually the entire length of the cable within the housing and is electrically connected to the cable at plural equidistantly spaced locations therealong. Thus, the anode 22 comprises plural segments 40, with each segment having a trailing end and a leading end which are electrically connected to respective portions of the electrical conductor(s) of the cable 24. The anode assembly 20 can include any number of anode segments, depending upon the length of the anode assembly. The trailing end of the first anode segment 40A is electrically connected to the conductor(s) of the cable 24 at a first connection 24A which is located adjacent the trailing end of the anode assembly. The leading end of the first anode segment 40A is electrically connected to the conductor(s) of the cable 24 at a second connection 24B. The second connection 24B is located at a predetermined distance, e.g. X meters, from the first connection 24A. The trailing end of the next successive anode segment 40B is also electrically connected to the conductor(s) of the cable 24 at the connection 24B. The leading end of the anode segment 40B is electrically connected to the conductor(s) of the cable 24 at a third connection 24C which is located a predetermined distance, e.g., X meters, from the connection 24B. Successive segments are connected to the cable 24 in the same manner, with the leading end of the last segment 40N, i.e., the segment located closest to the leading end of the anode assembly being connected to the cable at a connection 24N located adjacent the leading end of the housing. Thus, the anode segments 140A-140N and the cable 24 run in parallel to each other through the fabric housing 26, with the backfill 28 surrounding them within the fabric housing.

The integrity of each anode-to-wire (cable) electrical connection 24A-24N is critical and is preferably achieved by means of a KYNEX® connection. The KYNEX® connection is the subject of U.S. Pat. No. 8,502,074 (Schutt), which is also assigned to Matcor, Inc. and whose disclosure is incorporated by reference herein. Each connection 24A-24N basically comprises a first open region at which the anode segment is electrically connected to the elongated electrical conductor to form a good electrically conductive joint and a body of an electrically insulating material 32. The body of electrically insulating material 32 is molded in situ about the joint so that it completely covers and encapsulates the joint and is integrally bonded directly to portions of the electrically insulation on the cable contiguous with the open region. This arrangement electrically insulates the joint and prevents the ingress of water or other materials into the joint.

It should be pointed out that the KYNEX® connection is not the only way that anode segments are connect to the cable of a linear anode assembly. Thus, other manufacturers of linear anodes make use of other types of connections, e.g., a mechanical connection in conjunction with a heat shrink tube to encapsulate the connection point (the electrical joint).

Irrespective of the type of connection used between the anode 22 and the cable 24 at the various connection points therealong, prior art linear anodes are susceptible to the attenuation problem described above.

In contradistinction, the anode assembly 120 of this invention overcomes that problem by eliminating the continuous (albeit segmented) wire anode element and replacing it with an anode whose segments are spaced apart from each other. This "stitch" approach, while not visible from the exterior of the anode assembly, enhances the anode's performance in a corrosion protection system. In particular, by spacing the anode segments out along the entire assembly (versus one effectively "continuous" internal anode like the SPL-FBR anode assembly) the subject anode assembly permits one to power longer lengths of anode from a single location with a given DC power supply inasmuch as the attenuation would be significantly reduced. Thus, users of the anode assembly of this invention are able to run longer lengths of anode from a fixed source of power.

The anode assembly 120 is shown in FIG. 2 and basically comprises an SPL-FBR anode assembly with a modified anode. In the interest of brevity the common features of the anode assemblies 120 and 20 will be given the same reference numbers and the details of the construction, arrangement and operation of those features will not be reiterated. Thus, as can be seen in FIG. 2 the anode assembly 120 basically comprises an anode 122, an internally insulated electrical conductor or cable 24, a porous outer fabric or cloth housing 26, an electrically conductive backfill 28, and external braiding 30. The anode assembly 120 can be of any length, from 10 feet to lengths of more than 1,000 feet, but is particularly useful when provided in long lengths due to its resistance to attenuation loss at greater lengths than conventional linear anode assemblies (e.g., the SPL-FBR anode assembly of Matcor, Inc. and anode assemblies from other manufacturers).

The anode 122 is formed of elongated thin flexible member, e.g., a wire, a ribbon, a tube, etc., which is electrically conductive, like that of the anode 22. The anode 122 extends along the cable 24 within the housing and is connected to the conductor(s) of the cable at equidistantly located points therealong. However, unlike the anode 22 it is not continuous, i.e., it includes segments 140 which are separated from each other. Each segment has a trailing end and a leading end which are electrically connected to respective portions of the electrical conductor(s) of the cable. The anode assembly can include any number of anode segments, depending upon the length of the anode assembly.

As can be seen in FIG. 2, the trailing end of the first anode segment 140A is electrically connected to the conductor(s) of the cable 24 at a first connection 124A which is located adjacent the trailing end of the anode assembly 120. The leading end of the first anode segment 140A is electrically connected to the conductor(s) of the cable 24 at a second connection 124B. The second connection 124B is located at a predetermined distance, e.g. 3 meters, from the first connection 124A. Unlike the anode assembly 20, the trailing end of the next successive segment 140B of the anode 122 of the anode assembly 120 is not connected to the cable at the connection 124B. Rather it is connected to the conductor(s) of the cable 24 at a third connection 124C, which is located a predetermined distance, e.g., 6 or 9 meters, from the connection 124B. The leading end of the second anode segment 140B is electrically connected to the conductor(s) of the cable 24 at a fourth connection 124D. The fourth connection 124D is located at a predetermined distance, e.g. 3 meters, from the third connection 124C. Successive segments of the anode 122 are connected to the cable 24 in the same manner, with the leading end of the last segment 140N, i.e., the segment located closest to the leading end of the anode assembly being connected to the cable at a connection 124N located adjacent the leading end of the housing. Thus, the anode segments 140A-140N and the cable 24 run in parallel to each other through the fabric housing 26, with the backfill 28 surrounding them within the fabric housing, but with immediately adjacent segments being separated from each other by a gap.

Like the anode assembly 20, each electrical connection 24A-24N of the anode assembly 120 is accomplished by means of a connection which is the subject of U.S. Pat. No. 8,502,074 (Schutt).

As should be appreciated by those skilled in the art by segmenting the anode and extending the spacing between anode segments (versus one continuous internal anode) the subject anode assembly enables users to power longer lengths of anode from a single location as the attenuation would be significantly reduced. This allows users to run longer lengths of anode from a fixed source of power.

It should be pointed out at this juncture that in the exemplary embodiment the length of each anode segment is described as being 3 meters. That is merely exemplary. Thus, the lengths of each anode segment can be another value, if desired. So too, the spacing or gap between the adjacent anode segments is described as being either 6 or 9 meters. Those values are also merely exemplary. Thus, the spacing or gap between successive anode segments can be another value, if desired.

It should also be pointed out that other changes can be made in the anode assembly for other cathodic corrosion protection applications. Thus for example, the anode assembly can be constructed so that it does not include any fabric housing or other wrap. That variant anode assembly can be used in an application wherein the anode assembly is disposed within coke backfill in the ground or in an application wherein the anode is disposed directly within the ground without any coke backfill.

Without further elaboration the foregoing will so fully illustrate our invention that others may, by applying current or future knowledge, adopt the same for use under various conditions of service.

We claim:

1. An anode assembly for use in a cathodic protection system, said anode assembly having a leading end and a trailing end and comprising:

a) a continuous electrical cable extending the length of said anode assembly between said leading end and said trailing end, said continuous electrical cable having an electrically insulating covering thereon, said electrically insulating covering having at least first, second, third and fourth sequentially spaced openings therein, whereupon each of said openings exposes a respective sequential portion of said electrical cable thereat, said continuous electrical cable comprises at least one electrically conductive wire, wherein a first electrically conductive anode segment is electrically connected in parallel across said first and second sequentially spaced openings by respective first and second electrically conductive joints, and wherein a second electrically conductive anode segment is electrically connected in parallel across said third and fourth sequentially spaced openings by respective third and fourth electrically conductive joints, and wherein each of said electrically conductive joints comprises a body of electrically insulating material molded in situ about said electrically conductive joint so that it completely covers and encapsulates said electrically conductive joint and is integrally bonded directly to portions of said electrically insulated covering;

b) an anode comprising at least said first electrically conductive anode segment and said second electrically conductive anode segment, said first electrically conductive anode segment being electrically connected in parallel across said first and second sequentially spaced openings, said second electrically conductive anode segment being electrically connected in parallel across said third and fourth sequentially spaced openings; and c) an elongated housing, said continuous electrical cable extending through said housing between said leading end and said trailing end, said anode extending along said electrical cable within said housing, said elongated housing being filled with an electrically conductive backfill, said conductive cable being surrounded by said electrically conductive backfill, said first electrically conductive anode segment being spaced from said second electrically conductive anode segment by a gap but being electrically interconnected to each other indirectly by a portion of said continuous electrical cable extending between said second and said third sequentially spaced openings.

2. An anode assembly for use in a cathodic protection system, said anode assembly having a leading end and a trailing end and comprising:

a) a continuous electrical cable extending the length of said anode assembly between said leading end and said trailing end, said continuous electrical cable having an electrically insulating covering thereon, said electrically insulating covering having at least first, second, third and fourth sequentially spaced openings therein, whereupon each of said openings exposes a respective sequential portion of said electrical cable thereat;

b) an anode comprising at least a first electrically conductive anode segments and a second electrically conductive anode segment, said first electrically conductive anode segment being electrically connected in parallel across said first and second sequentially spaced openings, said second electrically conductive anode segment being electrically connected in parallel across said third and fourth sequentially spaced openings; and c) an elongated housing, said continuous electrical cable extending through said housing between said leading end and said trailing end, said anode extending along said electrical cable within said housing, said elongated housing being filled with an electrically conductive backfill, said electrically conductive cable being surrounded by said electrically conductive backfill.

* * * * *